US011805822B2

(12) United States Patent
Twydell-Satterly

(10) Patent No.: US 11,805,822 B2
(45) Date of Patent: Nov. 7, 2023

(54) WEARABALE DEVICE TO LIFT AREAS OF SKIN

(71) Applicant: Betina Twydell-Satterly, Weybridge (GB)

(72) Inventor: Betina Twydell-Satterly, Weybridge (GB)

( * ) Notice: Subject to any disclaimer, the term of this patent is extended or adjusted under 35 U.S.C. 154(b) by 163 days.

(21) Appl. No.: 17/331,937

(22) Filed: May 27, 2021

(65) Prior Publication Data

US 2021/0282470 A1 Sep. 16, 2021

Related U.S. Application Data

(63) Continuation of application No. PCT/EP2019/082091, filed on Nov. 21, 2019.

(30) Foreign Application Priority Data

Nov. 27, 2018 (GB) ..... 1819287

(51) Int. Cl.
*A41C 1/12* (2006.01)

(52) U.S. Cl.
CPC ..... *A41C 1/12* (2013.01)

(58) Field of Classification Search
CPC ..... A41C 3/00; A41C 3/065; A41C 1/12
USPC ..... 450/81
See application file for complete search history.

(56) References Cited

U.S. PATENT DOCUMENTS 2,289,679 A * 7/1942 Porter ..... A41C 3/144 450/57
2,524,620 A * 10/1950 Cadous ..... A41C 3/06 D2/706
2,628,356 A * 2/1953 Rosenfield ..... A41C 3/06 450/41
2,988,087 A * 6/1961 Krieger ..... A41C 3/06 450/81
3,254,653 A * 6/1966 Krieger ..... A41C 3/00 450/39
4,625,338 A 12/1986 Starling
(Continued)

FOREIGN PATENT DOCUMENTS

EP 3202272 8/2017
WO 2015139076 9/2015

OTHER PUBLICATIONS

International Search Report for International Application PCT/EP2019/082091, dated Jan. 27, 2020.
(Continued)

*Primary Examiner* — Gloria M Hale
(74) *Attorney, Agent, or Firm* — Burris Law, PLLC

(57) ABSTRACT

A wearable device for lifting an area of skin on a wearer's torso below the wearable device in use includes a gripping element with an outer surface, and an inner surface formed of or coated with a non-slip material. The gripping element includes a band configured to encircle a lower part of a wearer's ribcage. The non-slip material extends along the band and contacts the skin. The wearable device further includes at least one lifting element secured to the gripping element and configured to extend over a shoulder of the wearer and to be adjustable in length. In use, the at least one lifting element is adjustable to exert a lifting force on the gripping element, the skin gripped thereby, and an area of skin on the torso below the gripping element.

8 Claims, 3 Drawing Sheets

(56) References Cited

U.S. PATENT DOCUMENTS

| | | | | |
|---|---|---|---|---|
| 6,332,825 | B1 | 12/2001 | Henricksen | |
| 6,446,268 | B1 * | 9/2002 | Lazarian | A41F 9/00 427/256 |
| 7,228,809 | B2 * | 6/2007 | Angelino | D06M 23/18 156/181 |
| 7,422,508 | B2 * | 9/2008 | Bentham | A41C 3/0014 2/243.1 |
| 8,128,457 | B2 * | 3/2012 | Reinisch | A41C 3/0014 450/59 |
| 8,684,789 | B2 * | 4/2014 | Gramelspacher | A41C 3/00 450/92 |
| 9,516,905 | B2 * | 12/2016 | Pagnon | A41C 3/10 |
| 9,801,420 | B2 | 10/2017 | Hays et al. | |
| 10,231,492 | B1 * | 3/2019 | Bastug | A41C 3/10 |
| 2003/0186620 | A1 * | 10/2003 | Kaye | A41F 15/005 450/86 |
| 2005/0020184 | A1 * | 1/2005 | Izcoa | A41F 15/007 450/86 |
| 2009/0098803 | A1 * | 4/2009 | Reinisch | A41C 3/0014 450/86 |
| 2009/0126084 | A1 | 5/2009 | Fenske | |
| 2012/0225607 | A1 * | 9/2012 | Martinet | A41C 3/126 450/41 |
| 2016/0037832 | A1 * | 2/2016 | Kogon | A41C 3/12 450/86 |
| 2018/0177245 | A1 * | 6/2018 | Glaude | A41C 1/08 |
| 2019/0174841 | A1 * | 6/2019 | Bastug | A41C 3/0007 |

OTHER PUBLICATIONS

United Kingdom Search Report issued in corresponding GB Application 1819287.2, dated May 28, 2019.

* cited by examiner

WEARABALE DEVICE TO LIFT AREAS OF SKIN

CROSS-REFERENCE TO RELATED APPLICATIONS

This application is a continuation of International Application No. PCT/EP2019/082091, filed on Nov. 21, 2019, which claims priority to and the benefit of GB 1819287.2, filed on Nov. 27, 2018. The disclosures of the above applications are incorporated herein by reference.

FIELD

The present disclosure relates to a wearable device which lifts and smooths areas of the wearer's skin.

BACKGROUND

The statements in this section merely provide background information related to the present disclosure and may not constitute prior art.

Various wearable devices and garments are known which use panels of resilient material to compress and smooth out areas of the body, such as the stomach or arms. Examples can be found in U.S. Pat. Nos. 9,801,420 and 4,625,338. However, such garments act by completely covering and restraining the relevant body area and are usually worn as underwear below other items of clothing or are incorporated into other garments.

SUMMARY

This section provides a general summary of the disclosure and is not a comprehensive disclosure of its full scope or all of its features.

A wearable device is described below which acts to lift an area of a wearer's skin, rather than restraining or compressing it. The wearable device comprises a gripping element having an outer surface, and an inner surface formed of or coated with a non-slip material, wherein the gripping element is configured to fit around part of a wearer's body with the non-slip material contacting the skin, and further comprising at least one lifting element secured to the gripping element and configured to be adjustable in length, whereby in use, the at least one lifting element is adjustable so as to exert a lifting force on the gripping element, the skin gripped thereby, and an area of skin below the gripping element.

Specifically, the present disclosure provides a wearable device for lifting an area of skin on a wearer's torso below the device in use.

Thus, the wearable device of the present disclosure lifts and smooths an area of skin, for example on the wearer's stomach and lower back, without covering the area, so that the wearer can leave that area exposed if they wish.

The gripping element comprises a band having a front portion to be positioned across a wearer's front and a rear portion to be positioned across a wearer's back. A pair of lifting elements, each one of the pair of lifting elements comprising a strap, are attached to the front portion and the rear portion of the band and configured to extend over a shoulder of the wearer.

The band may be a continuous loop or an elongate strip with two ends and co-operating attachment devices secured at each end.

In one form of the present disclosure, the gripping element is formed of a resilient material, such as a knitted fabric. The non-slip material of the inner surface of the gripping element may comprise a silicone-based material.

A variation of the present disclosure may also comprise a garment incorporating a wearable device of the type described above.

Another form of the wearable device according to the present disclosure may be configured for use on the upper chest or décolletage area of a wearer. In particular, a wearable device for lifting an area of skin on a wearer's chest below the device in use may comprise a gripping element having an outer surface, and an inner surface formed of or coated with a non-slip material. The gripping element comprises an elongated strip configured to lie across the upper chest or décolletage area of a wearer and the non-slip material extends along the strip and contacts the skin. The wearable device further comprises lifting elements, one of the lifting elements being secured to each end of the gripping element and the lifting elements being configured to be adjustably attachable to each other behind the neck of the wearer, whereby in use the lifting elements are operable to exert a lifting force on the gripping element, the skin gripped thereby, and an area of skin on the chest below the gripping element.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
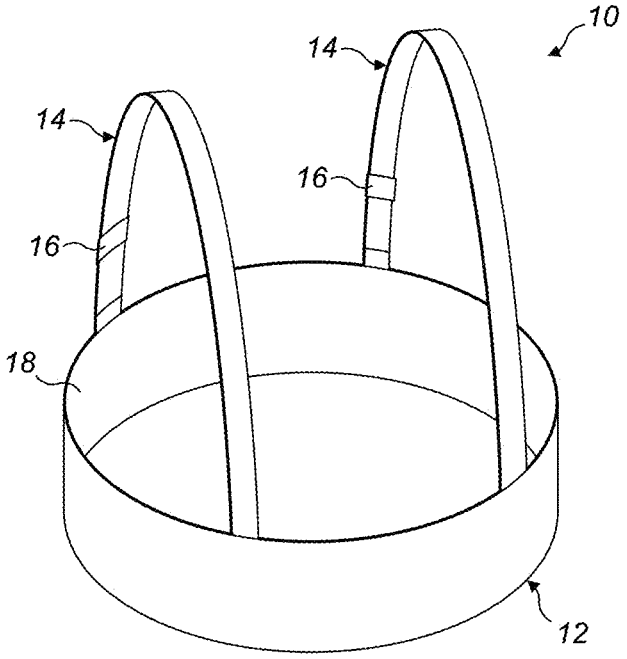
FIG. 1 is a schematic perspective view of a wearable device according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a wearable device 10 comprises a gripping element 12 and at least one lifting element 14. In one form of the present disclosure, the gripping element 12 is a band configured to encircle a wearer's torso and a pair of lifting elements (in the form of straps, as shown) 14 are attached to front and rear portions of the band and are configured to extend over the shoulders. Each one of the pair of lifting elements 14 includes a length adjustment member 16, for example in the same manner as a conventional bra strap.

A single lifting element 14 may also be used, for example in the form of a single strap extending over one shoulder or a Y-shaped strap having two separate portions which merge together. For example, there may be two straps at the front and passing over the shoulders, which merge into a single strap at the back, or vice versa.

The gripping element 12 may be formed of a resilient or elastic material, e.g. a knitted fabric, which can stretch slightly to help the wearer put it on and take it off. The gripping element 12 may be sized so that when in position it will be slightly in tension to provide a secure fit. The gripping element 12 comprises an outer surface and an inner surface. The inner surface 18 is formed of or coated with a non-slip material that will grip a wearer's skin and resist any relative slipping. The non-slip material may, for example, comprise a silicone-based material such as is commonly used in hold-up stockings. However, non-silicone versions of such non-slip materials may also be used. These non-slip materials have a rubbery or gel-like consistency which has a slightly sticky feel so that it will gently adhere to a wearer's skin and resist slipping, but is easily removable by peeling away from the skin.

Figure 2:
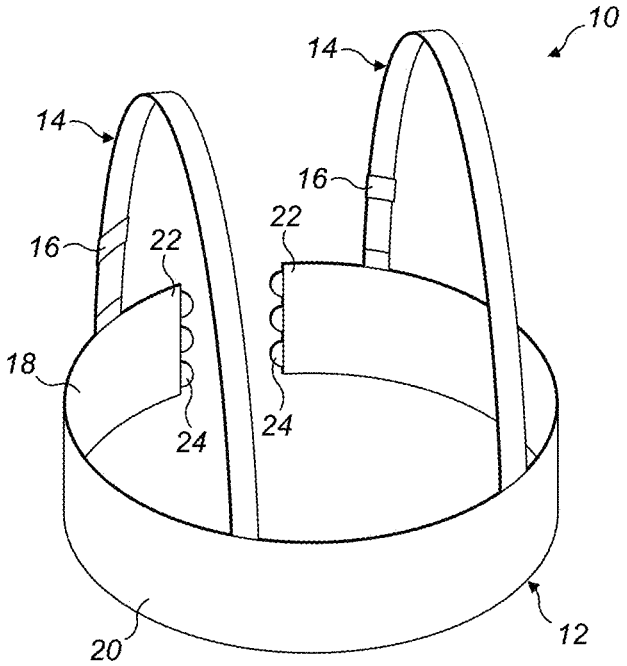
FIG. 2 is a schematic perspective view of a variation of the wearable device according to FIG. 1.

Referring again to FIG. 1, the gripping element 12 is a continuous loop, which a wearer would normally put over their head in order to put it on. Alternatively, as shown in FIG. 2, the gripping element 12 may comprise an elongate strip 20 which can be fitted around a wearer's torso. Ends 22 of the strip 20 can then be secured together by suitable fastener 24 to form a loop. The fastener 24 may be of any convenient form, for example hook and eye fasteners as conventionally used on bras. The ends 22 of the strip 20 may be joined together in the center of the wearer's back, at the center of the wearer's front, or elsewhere as desired. This form of the present disclosure may be easier for a wearer to put on and take off.

Figure 3:
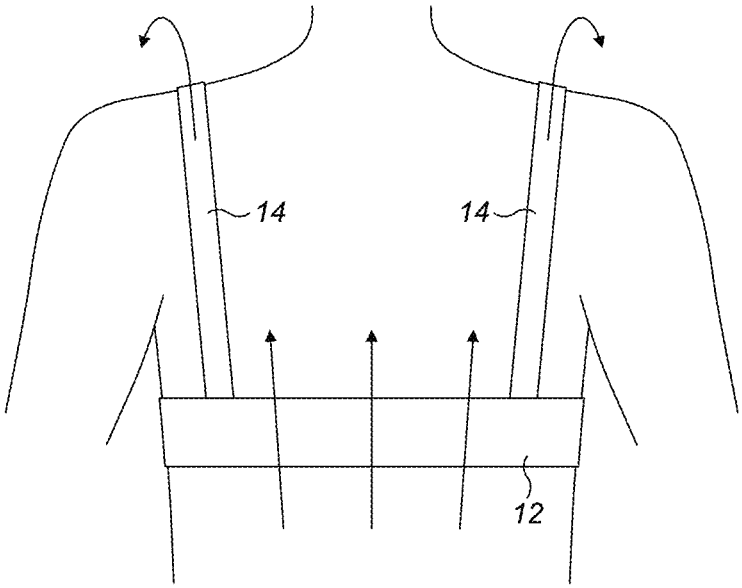
FIG. 3 is a schematic view of a wearer's torso wearing a wearable device as shown in FIG. 1 or 2.

In use, a wearer fits the gripping element 12 around the torso, typically positioning the gripping element 12 around the lower part of the rib cage. For women, the gripping element 12 is positioned below the bust. The at least one lifting element 14 is positioned to extend over the wearer's shoulders, as shown in FIG. 3. The at least one lifting element 14 is then shortened or tightened, using the adjustment member 16 to exert an upward lift on the gripping element 12. The non-slip material on the inner surface 18 of the gripping element 12 grips the skin it contacts without slipping and therefore the upward movement of the gripping element 12 serves to lift the skin with it. The skin below the gripping element 12 is also lifted and smoothed out. Thus, the appearance of any loose skin beneath the gripping element 12 is improved. The upward lift is illustrated generally by the arrows in FIG. 3. The upward lifting sensation may also act as a physical trigger to the wearer to encourage a good upright posture.

The non-slip material on the inner surface 18 of the gripping element 12 may extend substantially continuously around the entire circumference or along the whole length of the gripping element 12. In one form of the present disclosure, the non-slip material on the inner surface 18 covers a large surface area so as to contact a large area of skin to improve the gripping and lifting effect. Therefore, the non-slip material on the inner surface 18 may be, for example, about 2-4 cm in width. Alternatively, two or more narrower portions of non-slip material on the inner surface 18, for example about 5 mm in width, may be provided.

The wearable device 10 may be a completely separate item that a wearer can use in addition to any other clothing. Alternatively, the wearable device 10 may be incorporated within a garment, for example within a bra, a bikini top, a bralette, a cropped top, or similar, which is designed to fit around and cover the bust area, while leaving the stomach and lower back exposed.

Figure 6A:
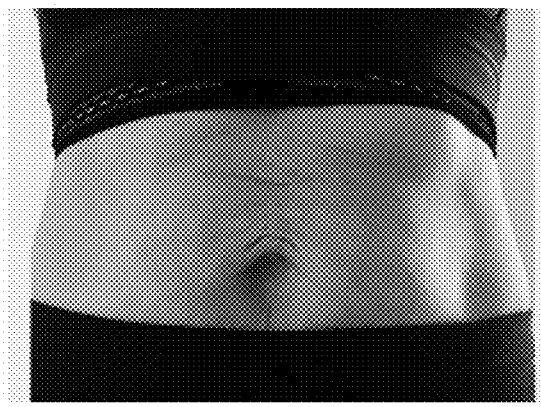
FIGS. 6*a* and 6*b* are photographs of a wearer wearing the wearable device of the present disclosure before (FIG. 6A) and after (FIG. 6B) adjusting the lifting elements to lift the gripping element.
Figure 6B:
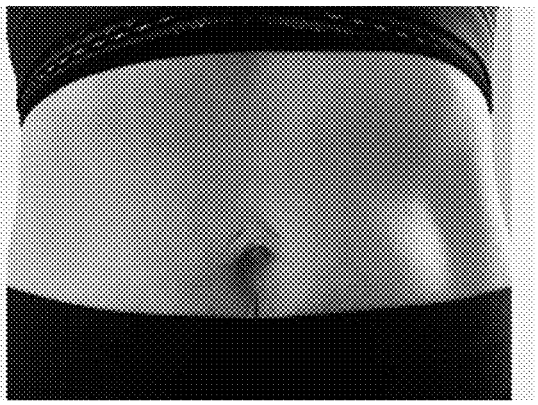

FIGS. 6*a* and 6*b* show an example of the wearable device 10 of the present disclosure in use. In FIG. 6*a*, the wearer is wearing the wearable device 10 but has not yet adjusted the at least one lifting element 14 and loose skin on the wearer's stomach is visible. In FIG. 6*b*, the at least one lifting element 14 has been adjusted to lift the gripping element 12, thereby lifting and smoothing the skin on the stomach below the gripping element 12.

Figure 4:
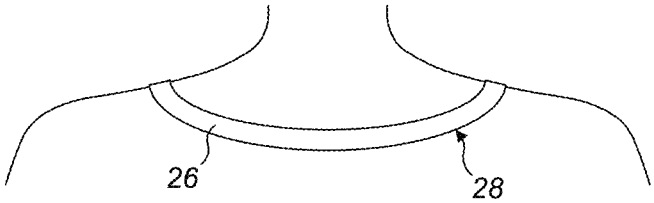
FIG. 4 is a schematic front view of a wearer wearing a wearable device according to another form of the present disclosure.
Figure 5:
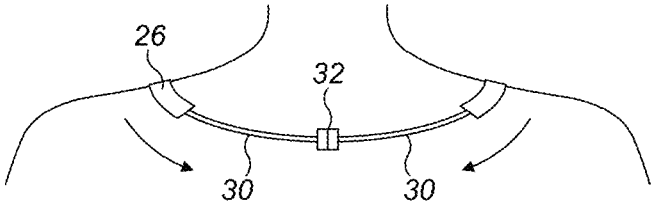
FIG. 5 is a schematic rear view of a wearer wearing the wearable device of FIG. 4.

Another form of the present disclosure for use on the décolletage area, i.e. the upper chest just below the neck, is illustrated in FIGS. 4 and 5.

In this form, the wearable device 10 comprises a gripping element (in the form of an elongated strip, as shown) 26 which can be applied to a wearer's skin across the upper chest area just below the base of the neck. As with the forms of the present disclosure described above, the gripping element 26 may comprise a resilient material, with an outer surface, and an inner surface 28 provided with a non-slip material. As seen in FIG. 4, the gripping element 26 may be generally U-shaped or V-shaped to lie across the wearer's décolletage area in the same manner as a necklace. Accordingly, the outer surface may be formed with a decorative finish, for example a luxury fabric and/or it may be embellished with beading, etc. Ends of the gripping element 26 may extend a short distance over the shoulders and towards the back of the wearer's neck.

Lifting elements 30 are attached to the ends of the gripping element 26. In one form, the lifting elements 30 are secured together behind the wearer's neck and are adjusted so as to exert a pull on the gripping element 26 (as indicated by the arrows in FIG. 5) to lift and smooth the skin below the gripping element 26 in the décolletage area. For example, the lifting elements 30 may comprise length-adjustable straps which can be joined together by a suitable clasp or fastener 32. The lifting elements 30 may also comprise elongated elements of fabric, cord, or ribbon which can be joined by tying them together, as tightly to provide the desired lifting effect on the gripping element 26.

This form of the wearable device 10 of the present disclosure may also be incorporated into a garment. For example, some designs for dresses and tops leave the décolletage area uncovered. The gripping element 26 may be incorporated into such a garment as a neckline feature, whilst still leaving the décolletage area below it uncovered.

When incorporated into a garment, the lifting elements 30, rather than attaching together behind the neck, may extend down the wearer's back and attach to another part of the garment such as the back of a bodice.

A garment may also be designed to include both forms of the present disclosure, that is with a gripping element configured to encircle the torso, with one or more lifting elements extending over the shoulders, and a further gripping element configured to lie across the décolletage area which may be attached to the same lifting element straps so that they lift both gripping elements when tightened.

Thus, the present disclosure provides a wearable device which is effective to lift an area of a wearer's skin without completely covering the area. This may improve the wearer's appearance, which may be beneficial to the wearer's self-esteem and general mental health, without the need for further action such as plastic surgery, which may involve significant risks.

It should be appreciated that the precise design of the wearable device and any garment which incorporates it can have many variations whilst still falling within the scope of the present disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A wearable device for lifting an area of skin on a wearer's torso below the wearable device in use, the wearable device comprising a gripping element having an outer surface, and an inner surface formed of or coated with a non-slip material, wherein the gripping element comprises a band configured to encircle a lower part of a wearer's rib cage, and the non-slip material extends along the band and contacts the wearer's skin, and the wearable device further comprises at least one lifting element directly secured to front and rear portions of the gripping element and configured to extend over a shoulder of the wearer and to be adjustable in length, whereby in use, the at least one lifting element is adjustable so as to exert a lifting force on the gripping element, the skin gripped thereby, and an area of skin on the wearer's torso below the gripping element.

2. The wearable device according to claim 1, wherein the band comprises a front portion to be positioned across a wearer's front and a rear portion to be positioned across a wearer's back and a pair of lifting elements, each of the pair of lifting elements comprising a strap attached to the front and rear portions of the band and configured to extend over a shoulder of the wearer.

3. The wearable device according to claim 1, wherein the band is a continuous loop.

4. The wearable device according to claim 1, wherein the band comprises an elongate strip with two ends and co-operating attachment devices secured at each of the two ends.

5. The wearable device according to claim 1, wherein the gripping element is formed of a resilient material.

6. The wearable device according to claim 5, wherein the gripping element is formed of a knitted fabric.

7. The wearable device according to claim 1, wherein the inner surface of the gripping element comprises a silicone-based material.

8. A garment comprising the wearable device according to claim 1.

* * * * *